US005683142A

United States Patent [19]

Gunderson et al.

[11] Patent Number: 5,683,142

[45] Date of Patent: Nov. 4, 1997

[54] MOUNTING ASSEMBLY FOR CHAIR BACK

[75] Inventors: Martin E. Olson Gunderson; Yun Feng; Mark D. Dart, all of Green Bay, Wis.; Willis T. Johnson, Booneville, Miss.

[73] Assignee: Krueger International, Inc., Green Bay, Wis.

[21] Appl. No.: 666,259

[22] Filed: Jun. 20, 1996

[51] Int. Cl.[6] ..... A47C 7/00

[52] U.S. Cl. ..... 297/440.21; 297/354.11

[58] Field of Search ..... 297/354.1, 354.11, 297/440.2, 440.21; 292/150; 403/19, 18, 17, 16

[56] References Cited

U.S. PATENT DOCUMENTS 5,277,475 1/1994 Brandes ..... 297/354.11

5,326,155 7/1994 Wild ..... 297/440.21

5,520,441 5/1996 Citton ..... 297/440.21

*Primary Examiner*—Peter M. Cuomo

*Assistant Examiner*—Anthony D. Barfield

*Attorney, Agent, or Firm*—Andrus, Sceales Starke and Sawall

[57] ABSTRACT

A mechanism for releasably mounting a chair back to a back support member comprises a connecting pin secured to the support member, and a receiver member secured to the chair back and receiving the connecting pin. The connecting pin is slidable and pivotable with respect to the receiver member along a longitudinal axis of the connecting pin between a locked position in which the chair back is joined to the chair support member, and a release position in which the chair back is separable from the chair support member. A locking bar is slidable into engagement with the receiver member for establishing the locked position, and is disengageable from the receiver member to enable movement of the chair back to the release position.

21 Claims, 2 Drawing Sheets

FIG. 5
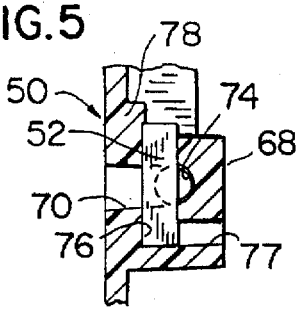
FIG. 4
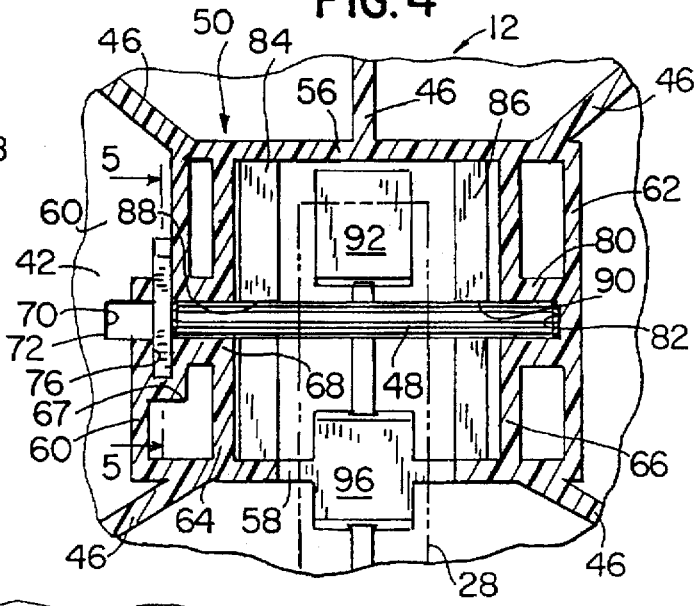
FIG. 6
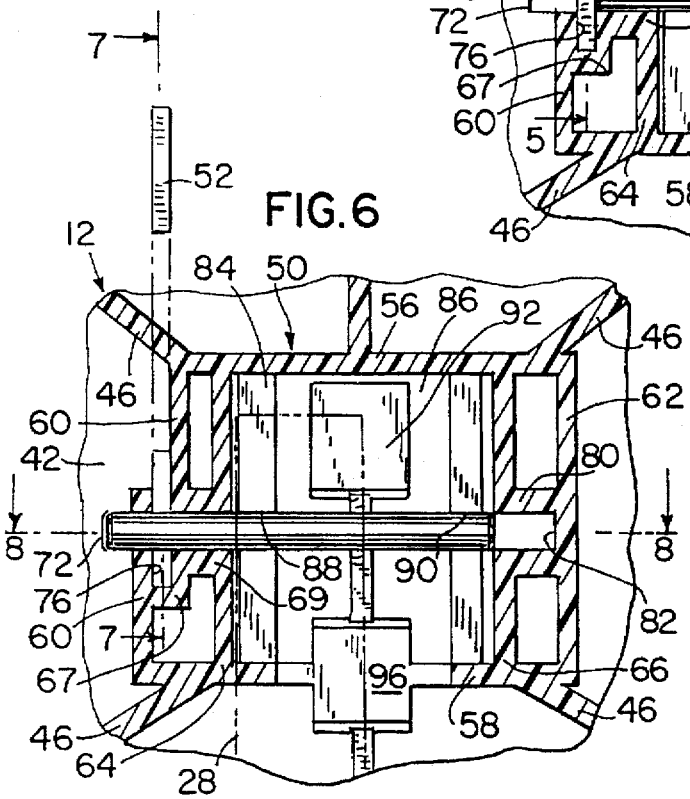
FIG. 7
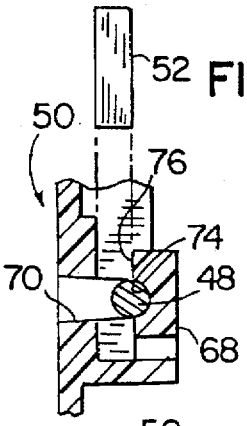
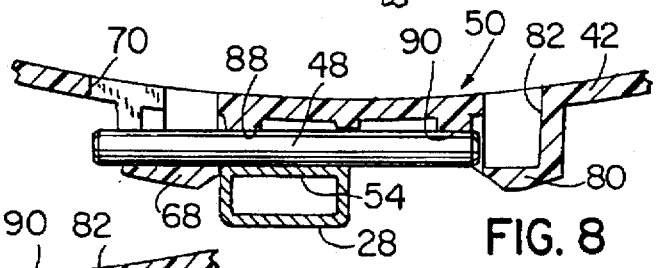
FIG. 8
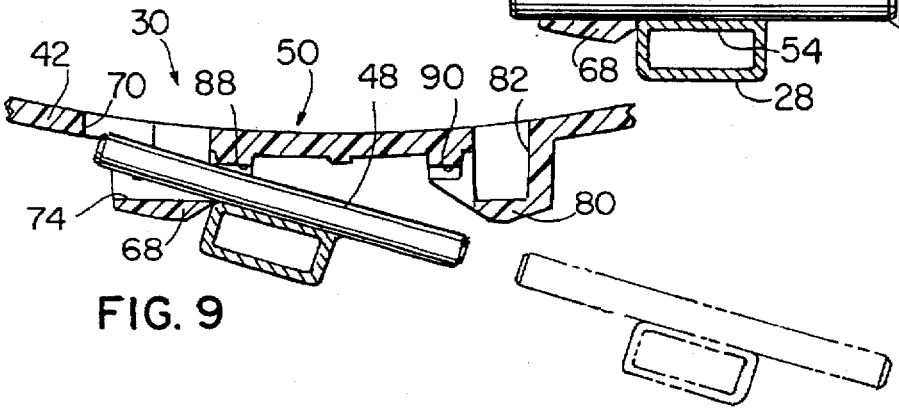
FIG. 9

MOUNTING ASSEMBLY FOR CHAIR BACK

FIELD OF THE INVENTION

The invention relates generally to the field of chairs, and, more particularly, pertains to a mechanism for releasably mounting a chair back to a chair support member.

BACKGROUND OF THE INVENTION

Characteristically, swivel chairs include a base to which a seat is mounted for swivelling movement. An upright support extends upwardly from the seat, and generally includes a chair back mounted at the upper end of the upright support. Normally, the chair back is pivotally mounted to the upright support so that its position will adjust in response to movement of the back of a person seated on the chair. It is desirable that the chair back be removable from the upright support for several reasons. First, it is not uncommon for a chair to be shipped in a "knock-down" or disassembled condition so as to minimize shipping costs. Consequently, assembly of the chair sometimes depends upon the retailer or the ultimate customer. In either event, assembly should be a relatively simple, easy task accomplished with a minimum of power or hand tools. In addition, removability of the back enables the back to be replaced, serviced or reupholstered without the need to transport the entire chair.

Most swivel chairs include pivotal mountings between the chair back and the upright support to which the chair back is mounted. Typically, these pivotal mountings may be complex and difficult for an unskilled customer or retailer to assemble and consequently, some swivel chairs are shipped with the chair back and upright support in an assembled condition. This manner of shipment is not optimal since it wastes shipping space, but it avoids having customers assemble complex pivotal assemblies.

It is therefore an object of the present invention to provide a pivotally interconnectable chair back and upright support of simple design permitting the upright support and the chair back to be shipped in "knock-down" condition and easily assembled by the customer. It is a further object of the invention to provide an easily assembled chair back and upright support assembly providing pivotal movement between the chair back and the upright support thereby providing maximum comfort in combination with an easily assembled structure. It is a further object of the invention to provide a chair back for a swivel chair wherein the pivotal connection between the chair back and the upright support is completely enclosed, thereby enhancing the appearance of the chair.

SUMMARY OF THE INVENTION

The present invention advantageously provides a simplified chair back mounting mechanism designed so that the operating elements and structural features required for operation are integrally formed, insofar as possible, in the chair back and upright support members themselves. The mechanism requires a minimum number of components which are simple to operate, compactly arranged and easy and economical to manufacture. Its compactness enables the mechanism to be neatly installed with minimum spatial requirements in a manner which retains the aesthetic appearance of the chair.

In one aspect of the invention, a mechanism for releasably mounting a chair back to a chair support member includes a connector secured to the chair support member and a receiver secured to the chair back and receiving the connector. The receiver and the connector are movable with respect to each other between a locked position in which the chair back is joined to the chair support member and a release position in which the chair back is separable from the chair support member. A locking member is engageable with and disengageable from the receiver for establishing the locked position and the release position.

In another aspect of the invention, a mechanism for releasably mounting a chair back to a chair support member includes a connecting pin secured to the support member and a receiver member secured to the chair back and receiving the connecting pin. The connecting pin is slidable and pivotable with respect to the receiver member along a longitudinal axis of the connecting pin between a locked position in which the chair back is joined to the chair support member, and a release position in which the chair back is separable from the chair support member. A locking bar is slidable into and out of engagement with the receiver member for establishing the locked position and the release position of the connecting pin.

In yet a further aspect of the invention, a method for releasably locking a chair back to a back support member involves the steps of securing a connector to the support member; mounting a receiver on the chair back for engagement with the connector such that the connector and the receiver are movable with respect to each other between a locked position in which the chair back is secured to the chair support member, and a release position in which the chair back is separable from the chair support member; and providing a locking member which is engageable and disengageable with the receiver to establish the locked position and the release position.

Still yet a further aspect of the invention contemplates a method of selectively connecting and disconnecting a chair back to a chair support member. The method includes the steps of securing a connector having a pair of opposed ends to the chair support member and providing receiver on the chair back. The receiver has a first bearing structure and a second bearing structure spaced from the first bearing structure. The method further includes slidably mounting the connector within the receiver such that a first one of the opposed ends of the connector is retained in the first bearing structure and a second one of the opposed ends of the connector is retained in the second bearing structure. A locking member is engageable with the receiver and movable into engagement with the first end of the connector to prevent sliding movement between the connector and the receiver and establish a locked position in which the chair back is connected to the chair support member. To remove the chair back from the support member, the locking member is removed from the receiver and the connector is slid relative to the receiver so as to remove the second end of the connector from the second bearing structure, to establish a release position in which the chair back is separable from the chair support member. The connector is pivoted upon the receiver to swing the second end of the connector away from the receiver, and a pulling force is applied along the longitudinal axis of the connector for removing the first end of the connector from the first bearing structure to disconnect the chair back from the chair support member.

Various other features, object and advantages of the invention will be made apparent from the following description taken together with the drawings.

BRIEF DESCRIPTION OF THE DRAWINGS

The invention will become better understood by reference to the following detailed description of the preferred exemplary embodiment when read in conjunction with the appended drawing, wherein like numerals denote like elements and:

FIG. 4 is an enlarged, sectional view of the chair back mounting mechanism of FIGS. 1–3 showing the mechanism in a locked position;

FIG. 5 is a partial sectional view taken on line 5—5 of FIG. 4;

FIG. 6 is a sectional view similar to FIG. 4, showing the chair back mounting mechanism in a release position;

FIG. 7 is a partial sectional view taken on line 7—7 of FIG. 6;

FIG. 8 is a partial sectional view taken on line 8—8 of FIG. 6; and

FIG. 9 is a sectional view similar to FIG. 8 depicting the progressive disengagement of the chair back from the back support member.

DETAILED DESCRIPTION OF THE PREFERRED EXEMPLARY EMBODIMENT

Figure 1:
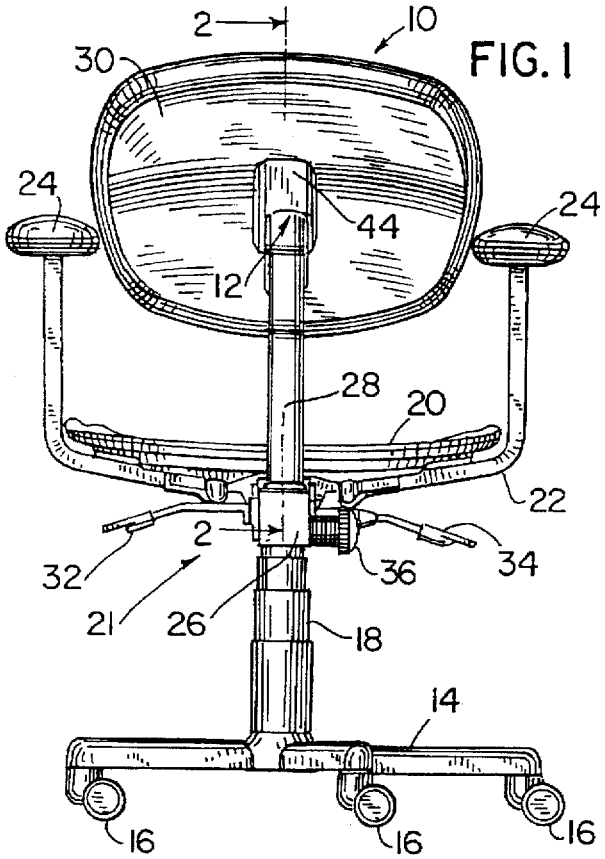
FIG. 1 is a rear elevational view of a chair including a chair back mounting mechanism according to the present invention.

Referring now to FIG. 1, a swivel chair identified generally by the reference numeral 10 includes a chair back mounting mechanism 12 embodying the present invention. Chair 10 comprises a base 14 having a plurality of casters 16 mounted thereon to permit free rolling of base 14 on a support surface. A vertical support column 18 extends upwardly from and is mounted to base 14. A seat 20 has a post (not shown) depending therefrom, which is mounted to column 18 in a conventional manner providing swivelling movement of seat 20 relative to base 14. A chair control mechanism, shown generally at 21, is interposed between seat 20 and the seat post, in accordance with conventional technology, for controlling the height and tilt angle of seat 20, in a manner as is known. A pair of arm supports 22 extend laterally underneath seat 20, with one arm support 22 located on each side of chair control mechanism 21, for mounting a pair of chair arms 24. A chair back mounting mechanism 26 is interconnected with the rear of chair control mechanism 21, and the lower end of a rigid, metallic back support upright or bar 28 is secured to chair back mounting mechanism 26. A chair back 30 is pivotally mounted to the upper end of back support bar 28 via back mounting mechanism 12, in a manner to be explained, and pivots in response to movement of the back of a person seated on chair 10. Chair control mechanism 21 includes a first adjustment lever 32 to control the height of chair seat 20, a second adjustment lever 34 to regulate the tilt angle of chair seat 20, and a rotatable knob 36 to control the height of support bar 28. In accordance with the present invention, back mounting mechanism 12 functions to releasably lock chair back 30 to back support bar 28 while providing pivoting movement of back 30 relative to back support bar 28.

Figure 2:
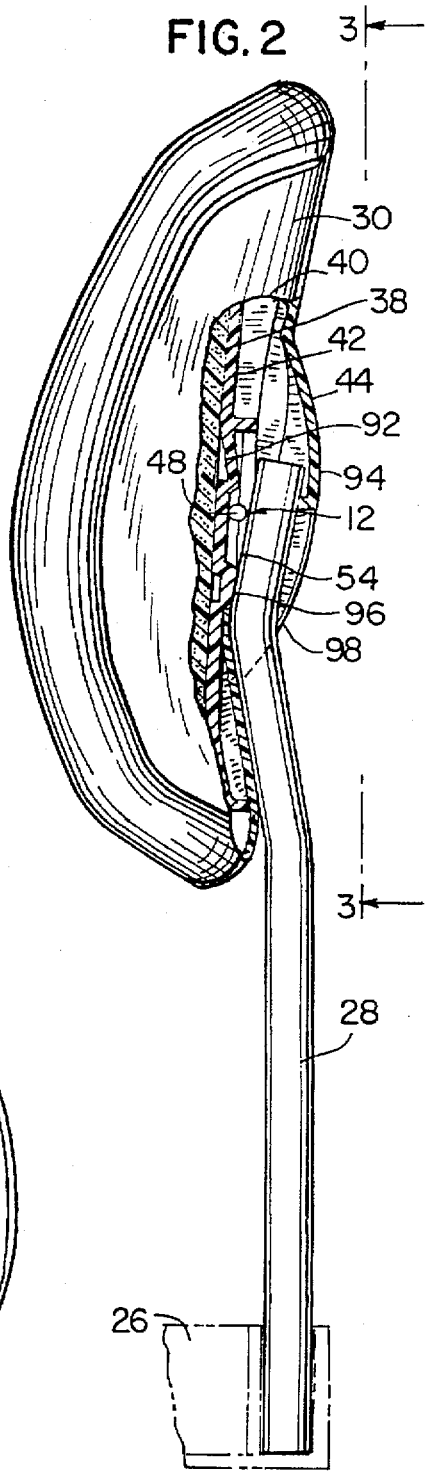
FIG. 2 is an enlarged, partial sectional view taken on line 2—2 of FIG. 1.
Figure 3:
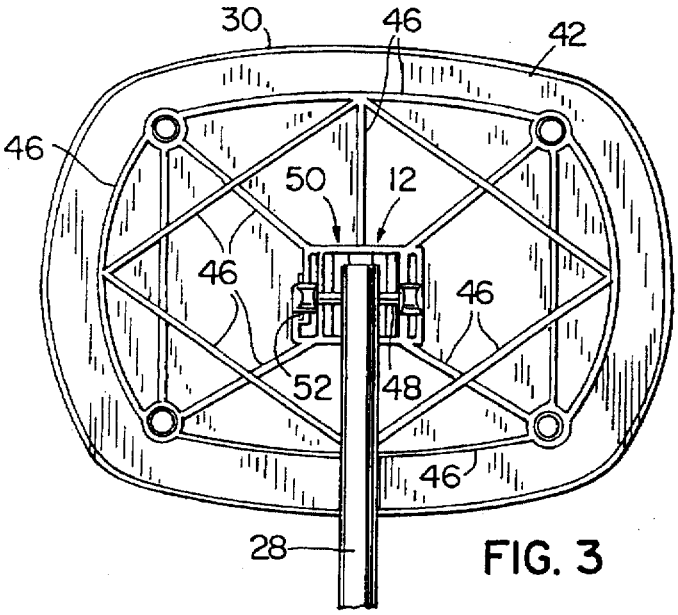
FIG. 3 rear elevational view of the chair back mounting mechanism of the invention, with reference to line 3—3 of FIG. 2 and in which the chair back shroud is removed.

Turning now to FIGS. 2 and 3, chair back 30 typically includes padding or cushioning 38 encased in a protective and decorative upholstery covering 40 for comfortably contacting the back of a person seated on chair 10. Chair back 30 also includes a contoured backboard 42 for supporting padding 38. Backboard 42 is preferably formed in an injection molding process from any satisfactory material, such as polypropylene, and the portion of mounting mechanism 12 associated with back 30 is preferably formed integrally with backboard 42. The Mounting mechanism 12 is concealed by a shroud 44 which is deleted from FIGS. 3–9 to more clearly illustrate the details of the mechanism 12. Releasable engagement structure is interposed between shroud 44 and backboard 42, so that shroud 44 can be manually mounted to backboard 42 by application of a push-on force and disengaged from backboard 42 by application of a pull-off force. As seen in FIG. 3, backboard 42 is formed with an array of rearwardly extending peripheral and intersecting ribs 46, which provide rigidity and reinforcement to the chair back 30. Several of these ribs 46 merge directly into mounting mechanism 12, which is located centrally in the backboard 42.

Mounting mechanism 12 is comprised of three main components, namely a connecting pin 48, a core or receiver member 50 and a locking bar 52.

Referring now to FIGS. 4 and 5, connecting pin 48 is a substantially horizontally disposed, cylindrical steel member which is preferably welded along a facial surface 54 (FIG. 8) to the upper end of back support bar 28 transversely to the longitudinal centerline thereof, such that opposed end portions of pin 48 extend one from either side of bar 28. Pin 48 is adapted to be pivotably and slidably secured to receiver member 50, which projects integrally and rearwardly from the backboard 42. Receiver member 50 is a generally rectangular, plastic component having an upper wall 56, a lower wall 58, a pair of parallel sidewalls 60, 62 and a pair of parallel inner walls 64, 66, all of which are formed integrally with each other. Receiver member 50 is generally symmetrical except for sidewall 60, the lower portion of which jogs outwardly and downwardly at 67 relative to the upper portion.

A first semi-cylindrical bearing block 68 is molded integrally between inner wall 64 and sidewall 60. Bearing block 68 is formed with a large arcuate recess 70 having a length which extends axially of pin 48 from inner wall 64 to an end wall 72 located outside sidewall 60 on backboard 42. Recess 70 has a depth which extends from an inner arcuate surface 74 of bearing block 68 completely through the receiver member 50, and an opening onto the forward surface of backboard 42. Bearing block 68 also includes a vertically extending passage 76 which intersects recess 70 such that a portion of passage 76 extends from each side of recess 70. Passage 76 is closed at its bottom and open at its top for receiving locking bar 52 therein. A horizontal passage 77 (FIG. 5) is in communication with the lower end of passage 76 and opens onto the rearward surface of bearing block 68.

As can be appreciated, locking bar 52 functions to prevent leftward movement of pin 48. To maintain locking bar 52 in position, locking bar 52 is stapled to receiver member outside sidewall 60.

A second semi-cylindrical bearing block 80 is molded between sidewall 62 and inner wall 66 and includes an arcuate recess 82 which is closed by sidewall 62 but opens through inner wall 66. The depth of recess 82 is similar to recess 70 and extends completely through the receiver member 50 so as to open onto the forward surface of backboard 42. A pair of parallel, spaced apart ridges 84, 86 are positioned inwardly of inner walls 64, 66, respectively, and extend between upper wall 56 and lower wall 58. Provided in the central portion of each ridge 84, 86 are arcuate recesses 88, 90, respectively, for receiving pin 48. As shown in FIGS. 2, 4 and 6, an upper, angled contact surface 92 slopes upwardly from the plane of backboard 42 in the center of receiver member 50 beneath upper wall 56, for selective engagement with the upper end 94 of the support bar 28. A lower, angled contact surface 96 is formed in lower wall 58, and has a relatively flat face which is normally engageable with a lower portion 98 of support bar 28 below pin 48. Recesses 70, 82, 88, 90 are aligned with each other and enable pin 48 to slide and pivot with respect to receiver member 50 over a predetermined range of movement guided by recesses 88, 90.

With reference to FIGS. 4 and 5, pin 48 is normally held in a locked position with respect to receiver member 50 by means of locking bar 52, which engages the extreme left end of pin 48 when locking bar 52 is seated within passage 76 as shown in FIG. 4. In this position, the extreme right end of pin 48 is held against sidewall 62 of recess 82, and the ends of pin 48 are securely retained within bearing block passages 70, 82 such that pin 48 cannot move longitudinally relative to receiver member 50. With this construction, the chair back 30 is secured to support bar 28, and the pivotable mounting of bearing blocks 68, 80 to pin 48 provides pivotal movement of the chair back 30 relative to support bar 28. The range of movement of back 30 relative to support bar 28 is defined by engagement of upper contact surface 92 and lower contact surface 96 with support bar upper and lower portions 94, 98, respectively.

When it is desired to separate the chair back 26 from support bar 28, as shown in FIGS. 6–9, the user first removes the staple engaging locking bar 52 with sidewall 60, and locking bar 52 is pulled upwardly out of passage 76 along sidewall 60 so that pin 48 and receiver member 50 may slide relative to each other into a release position (FIGS. 6, 8). In the release position, the left end of pin 48 is received in the left end portion of recess 70 located outwardly of passage 76. Pin 48 is sized such that when its extreme left end contacts end wall 72 of recess 70, the extreme right end of pin 48 will be withdrawn from recess 82 in bearing block 80. Then, as illustrated in FIG. 9, back 30 is twisted relative to support bar 28 such that the right side of back 30 is moved forwardly and the left side of back 30 is moved rearwardly. This movement of back 30 causes pin 48 to pivot about the surface of the recess 88 such that the left end of pin 48 projects into the depth of the recess 70 and the right end of pin 48 is moved outwardly and rearwardly away from the receiver member 50. As shown in phantom in FIG. 9, back 30 is then moved leftwardly relative to support bar 28 so as to fully separate back 30 from support bar 28 for replacement, reupholstering or other service once the chair has been put into use. To easily reconnect the chair back 30 to support bar 28, the reverse procedure is followed.

It should be understood that the mounting mechanism 12 allows the chair to be shipped in a convenient, space saving "knock-down" condition. The chair back 26 and support bar 28 may be easily assembled without complexity by a customer or end-user without the need for tools. Such an arrangement results in economy and simplification of manufacture, reduction of assembly steps, and overall compactness. Unlike some prior art devices, no separate external latch devices are required such that the aesthetic appearance of the chair is not compromised and complicated operating instructions can be avoided.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

We claim:

1. In a chair assembly including a back and a back support member, a mechanism for releasably mounting the back to the back support member, the mechanism comprising:

an axially extending connector secured to said back support member;

a receiver secured to said chair back and including mounting structure for receiving said connector, said mounting structure being configured such that said receiver and said connector are movable with respect to each other along the longitudinal axis of said connector between a locked position in which said chair back is joined to said back support member and a release position in which said chair back is separable from said back support member; and a locking member selectively engageable with said receiver for maintaining said receiver and said connector in said locked position by selectively preventing movement of said receiver along the longitudinal axis of said connector, wherein said locking member is movable relative to said receiver for enabling movement of said chair back along the longitudinal axis of said connector to said release position.

2. The mechanism of claim 1, wherein said connector is mounted to said receiver mounting structure so as to provide sliding movement of said chair back and said connector between said locking and release positions, and wherein said receiver and said receiver mounting structure are configured such that, when said receiver and said connector are in the release position, a twisting movement between said chair back and said back support member about an axis transverse to the longitudinal axis of said connector and subsequent sliding movement along the longitudinal axis of said connector functions to remove the back from the back support member.

3. The mechanism of claim 1, wherein said receiver is pivotably mounted with respect to said connector when said connector and said receiver are in said locked position to provide pivoting movement of said back to said back support member about a pivot axis coincident with the longitudinal axis of said connector.

4. The mechanism of claim 1, wherein said connector is a generally cylindrical steel pin.

5. The mechanism of claim 1, wherein said chair back includes a backboard, and wherein said receiver is formed integrally with said backboard.

6. The mechanism of claim 1, wherein said back support member is a vertically disposed bar.

7. In a chair assembly including a back and a back support member, a mechanism for releasably mounting the back to the back support member, the mechanism comprising:

an axially extending connecting pin secured to said back support member;

engagement structure associated with said chair back and receiving said connecting pin, said engagement structure being pivotable with respect to said connecting pin about a pivot axis defined by the longitudinal axis of said connecting pin; and a releasable locking arrangement associated with said back, said locking arrangement accommodating pivoting movement between said pin and said engagement structure and being releasable so as to enable disengagement between said pin and said engagement structure by longitudinal sliding movement of said engagement structure relative to said pin along the longitudinal axis of said pin, for movement of said back between an engaged position for pivotably mounting said chair back to said back support member, and a disengaged position for separating said chair back from said back support member.

8. The mechanism of claim 7, wherein said chair back includes a backboard, and wherein said engagement structure is formed integrally with said backboard.

9. The mechanism of claim 7, wherein said locking arrangement comprises a locking member engageable with said engagement structure and said pin for retaining said back in its engaged position, and movable out of engagement with said pin for enabling movement of said back to its release position.

10. The mechanism of claim 7, wherein said connecting pin is substantially horizontally disposed and secured transversely relative to a longitudinal axis along which said back support member extends.

11. The mechanism of claim 7, wherein said engagement structure comprises a pair of parallel sidewalls and a pair of parallel ridges disposed between said sidewalls.

12. The mechanism of claim 11 wherein said engagement structure further includes a bearing block formed between each of said sidewalls and each of said ridges.

13. The mechanism of claim 12, wherein said bearing blocks and said ridges include horizontally aligned recesses for receiving said connecting pin therein.

14. The mechanism of claim 13, wherein said connecting pin is slidable into and out of said recesses in said bearing blocks for movement of said back between its engaged position and its disengaged position.

15. The mechanism of claim 14, wherein said connecting pin is disengageable from said engagement structure when said chair back is in its disengaged position by twisting movement of said chair back about an axis substantially perpendicular to the longitudinal axis of said connecting pin, and axial movement of said chair back along the longitudinal axis of said connecting pin.

16. The mechanism of claim 12, wherein one of said bearing blocks is formed with a vertically extending recess for receiving a locking member forming a part of said locking arrangement for maintaining said back in its engaged position.

17. The mechanism of claim 7, wherein said chair back engagement structure includes at least one sloping contact surface with which said back support member is engageable for limiting the pivotal movement of said chair back relative to said connecting pin.

18. The mechanism of claim 7, wherein said locking arrangement includes a locking member selectively engageable with said connecting pin for maintaining said back in its engaged position.

19. The mechanism of claim 18, wherein said locking member is selectively engageable with one of a pair of sidewalls associated with said engagement structure.

20. A method of selectively connecting a chair back to a back support member, the method comprising the steps of:

securing connector structure having a pair of opposed axially extending ends to said back support member;

providing a receiver on said chair back, said receiver having a first bearing structure and a second bearing structure spaced from said first bearing structure;

laterally moving said chair back relative to said receiver in a direction substantially parallel to the axes of the opposed ends, wherein said connector is slidably received within said receiver such that one of said opposed ends is retained in said first bearing structure and the other of said opposed ends is retained in said second bearing structure; and inserting a locking member into said receiver and into engagement with said one of said opposed ends to prevent sliding movement between said connector and said receiver and establish a locked position in which said chair back is connected to said chair support member.

21. The method of claim 20, wherein said chair back is removable from said back support member by:

removing said locking member from said receiver;

laterally sliding said receiver relative to said connector so as to remove said other of said opposed ends from said second bearing structure to establish a release position in which said chair back is separable from said back support member;

pivoting said receiver relative to said connector along an axis transverse to the axes of the opposed ends to swing said receiver away from said other of said opposed ends; and applying a pulling force to said chair back along the longitudinal axis of said connector for removing said one of said opposed ends from said first bearing structure to disconnect said chair back from said back support member.

* * * * *